US010087704B2

(12) United States Patent
Conner et al.

(10) Patent No.: US 10,087,704 B2
(45) Date of Patent: Oct. 2, 2018

(54) EXPANDABLE SUPPORT RING FOR PACKING ELEMENT CONTAINMENT SYSTEM

(71) Applicants: Nicholas S. Conner, Cypress, TX (US); Gary L. Anderson, Humble, TX (US); Frank J. Maenza, Houston, TX (US); Adrian R. Castro, Houston, TX (US)

(72) Inventors: Nicholas S. Conner, Cypress, TX (US); Gary L. Anderson, Humble, TX (US); Frank J. Maenza, Houston, TX (US); Adrian R. Castro, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 710 days.

(21) Appl. No.: 14/496,747

(22) Filed: Sep. 25, 2014

(65) Prior Publication Data

US 2016/0090813 A1 Mar. 31, 2016

(51) Int. Cl.
*E21B 33/12* (2006.01)
*E21B 33/128* (2006.01)

(52) U.S. Cl.
CPC ..... *E21B 33/1216* (2013.01); *E21B 33/12* (2013.01); *E21B 33/128* (2013.01); *E21B 33/1208* (2013.01)

(58) Field of Classification Search
CPC .... E21B 33/1216; E21B 33/12; E21B 33/128; E21B 33/1208
See application file for complete search history.

(56) References Cited

U.S. PATENT DOCUMENTS 2,799,345 A * 7/1957 Baker ..... E21B 33/1294 166/133
2004/0007366 A1* 1/2004 McKee ..... E21B 33/1216 166/387
2009/0255690 A1 10/2009 Conner et al.
2010/0101804 A1 4/2010 Vinson et al.
2011/0048744 A1* 3/2011 Conner ..... E21B 33/1216 166/387
2012/0133098 A1 5/2012 Farquhar
2013/0192853 A1 8/2013 Themig
(Continued)

OTHER PUBLICATIONS

International Search Report and Written Opinion of the International Searching Authority issued in related International Patent Application No. PCT/US15/46791 dated Oct. 19, 2015, 8 pages.
(Continued)

*Primary Examiner* — D. Andrews
*Assistant Examiner* — Tara E Schimpf
(74) *Attorney, Agent, or Firm* — Cantor Colburn LLP

(57) ABSTRACT

A packing element containment system includes a support member extending from a first end to a second end. One of the first and second ends includes a support ring engagement section. A support ring is carried by the support ring engagement section of the support member. The support ring is configured and disposed to shift relative to the support member converting an axial movement of one of the support ring and the support member to a radial expansion of the support ring to provide one of a support to an anti-extrusion ring and containment for a packing element.

20 Claims, 12 Drawing Sheets

(56) References Cited

U.S. PATENT DOCUMENTS

2013/0306330 A1 11/2013 Bishop et al.
2016/0208573 A1* 7/2016 Roselier ..... E21B 33/1216

OTHER PUBLICATIONS

Parker Hannifin Corporation, "Packing Elements: Custom Designed for the Most Challenging Applications", 2014, 4 pages, retrieved at: http://www.parker.com/literature/Engineered%20Seals%20Division/ESD%20Packing%20Elements%205612.pdf dated Jul. 1, 2016.

* cited by examiner

EXPANDABLE SUPPORT RING FOR PACKING ELEMENT CONTAINMENT SYSTEM

BACKGROUND

Packing elements are used for securing production tubing inside of casing or a liner within a borehole, for example. Packing elements are also used to create separate zones within a borehole. A packing element is mounted to a rigid support body, and carried by a conveyance tubular (such as a production tubing string) downhole to a desired position. The packing element is then set within an annular space between the conveyance tubular and the outer tubing, casing, or open-hole diameter, and held in place by a packing element containment system. Conventional packing element containment systems may fail when exposed to prolonged high working pressures and large extrusion gaps.

SUMMARY

A packing element containment system includes a support member extending from a first end to a second end. One of the first and second ends includes a support ring engagement section. A support ring is carried by the support ring engagement section of the support member. The support ring is configured and disposed to shift relative to the support member converting an axial movement of one of the support ring and the support member to a radial expansion of the support ring to provide one of a support to an anti-extrusion ring and containment for a packing element.

A method of containing a packing element includes shifting a support ring relative to a support member with an axial force, and transferring the axial force into a radial force through an outward expansion of the support ring.

BRIEF DESCRIPTION OF THE DRAWINGS

Referring now to the drawings wherein like elements are numbered alike in the several Figures.

DETAILED DESCRIPTION

Figure 1:
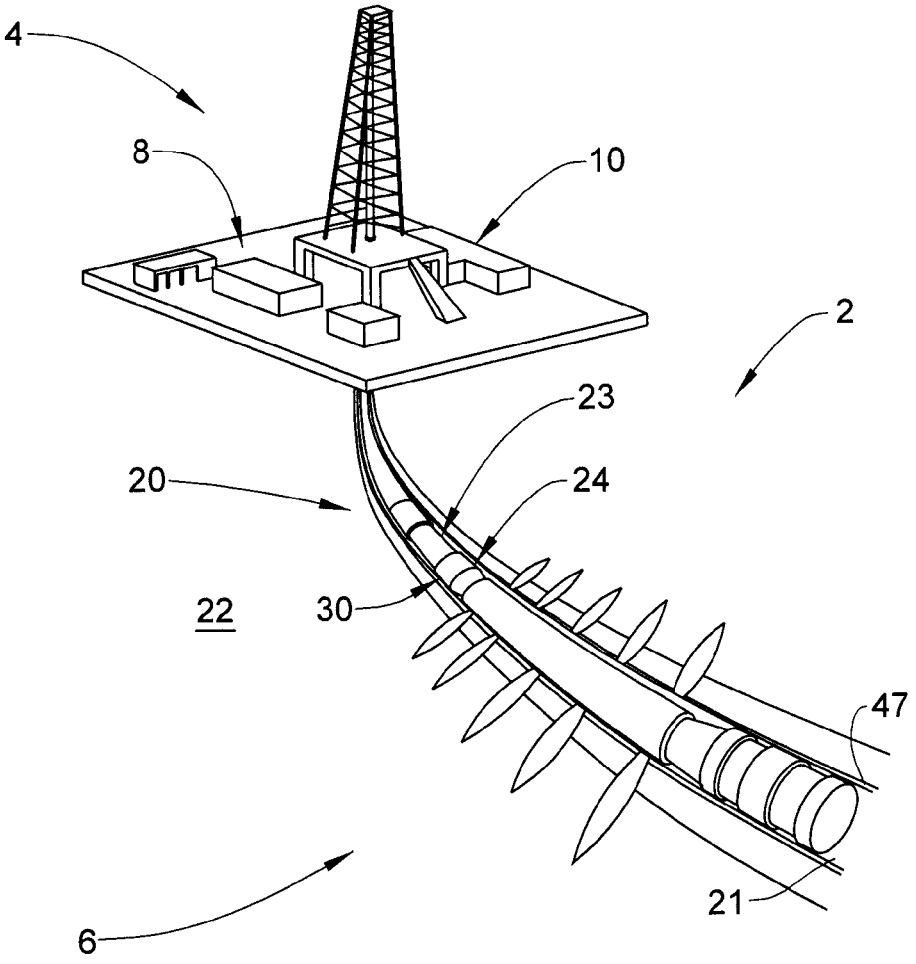
FIG. 1 depicts a downhole system including a downhole tool having a packing element containment system, in accordance with an exemplary embodiment.
Figure 2:
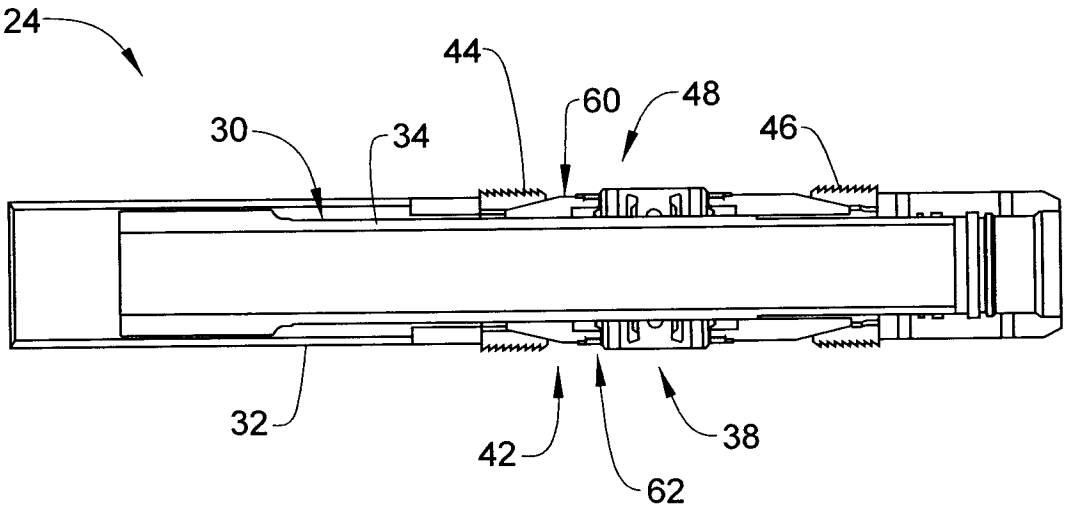
FIG. 2 depicts a portion of the downhole tool including the packing element containment system, in accordance with an aspect of an exemplary embodiment.

A resource extraction system, in accordance with an exemplary embodiment, is indicated generally at 2, in FIG. 1. Resource extraction system 2 includes an uphole system 4 operatively connected to a downhole system 6. Uphole system 4 may include pumps 8 that aid in completion and/or extraction processes as well as fluid storage 10. Fluid storage 10 may contain a completion fluid that is introduced into downhole system 6. Downhole system 6 may include a downhole string 20 that is extended into a bore 21 formed in formation 22. Downhole string 20 may include a number of connected downhole tools 23 such as a packer 24. As shown in FIG. 2, packer 24 in a set position may include a setting string 32 and an inner conduit 34 that supports a packing element 38 in a set configuration.

In accordance with an exemplary embodiment, a packing element containment system 42 is provided on inner conduit 34 to provide support for packing element 38. In addition, packer 24 includes slip components, indicated at 44 and 46. Packer 24 is introduced downhole into bore 21 to a desired position in formation 22. Packing element 38 is activated to move against a casing 47 in formation 22 to create a zonal isolation. Of course, it should be understood, that packing element 38 may be moved into contact with a tubular (not shown) or an open hole diameter (also not shown). As will be detailed more fully below, an axial force is delivered to packer 24 through setting string 32 and eventually into an anti-extrusion ring 48 provided adjacent to packing element 38. Packing element containment system 42 translates the axial force to a radial expansion that limits or prevents extrusion of packing element 38 depending on the configuration. At this point, it should be understood that packing element 38 may take on a variety of forms and should not be considered to be limited to the particular packing element shown. It should be further understood that packing element 38 may be formed from a variety of materials and may be present in various quantities downhole.

Figure 3:
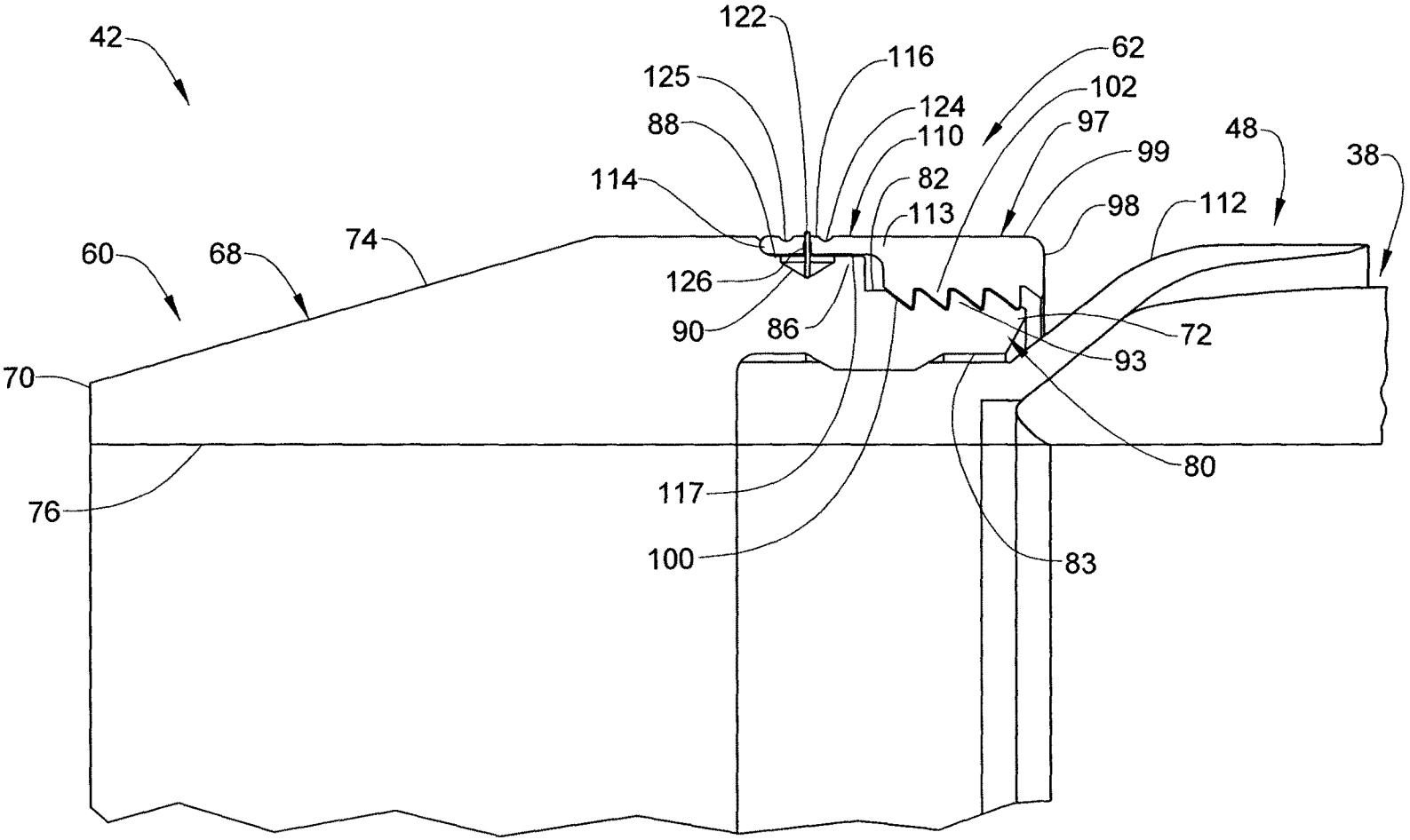
FIG. 3 depicts a partial cross-sectional view of a packing element containment system, in accordance with an exemplary embodiment in a run-in configuration.
Figure 4:
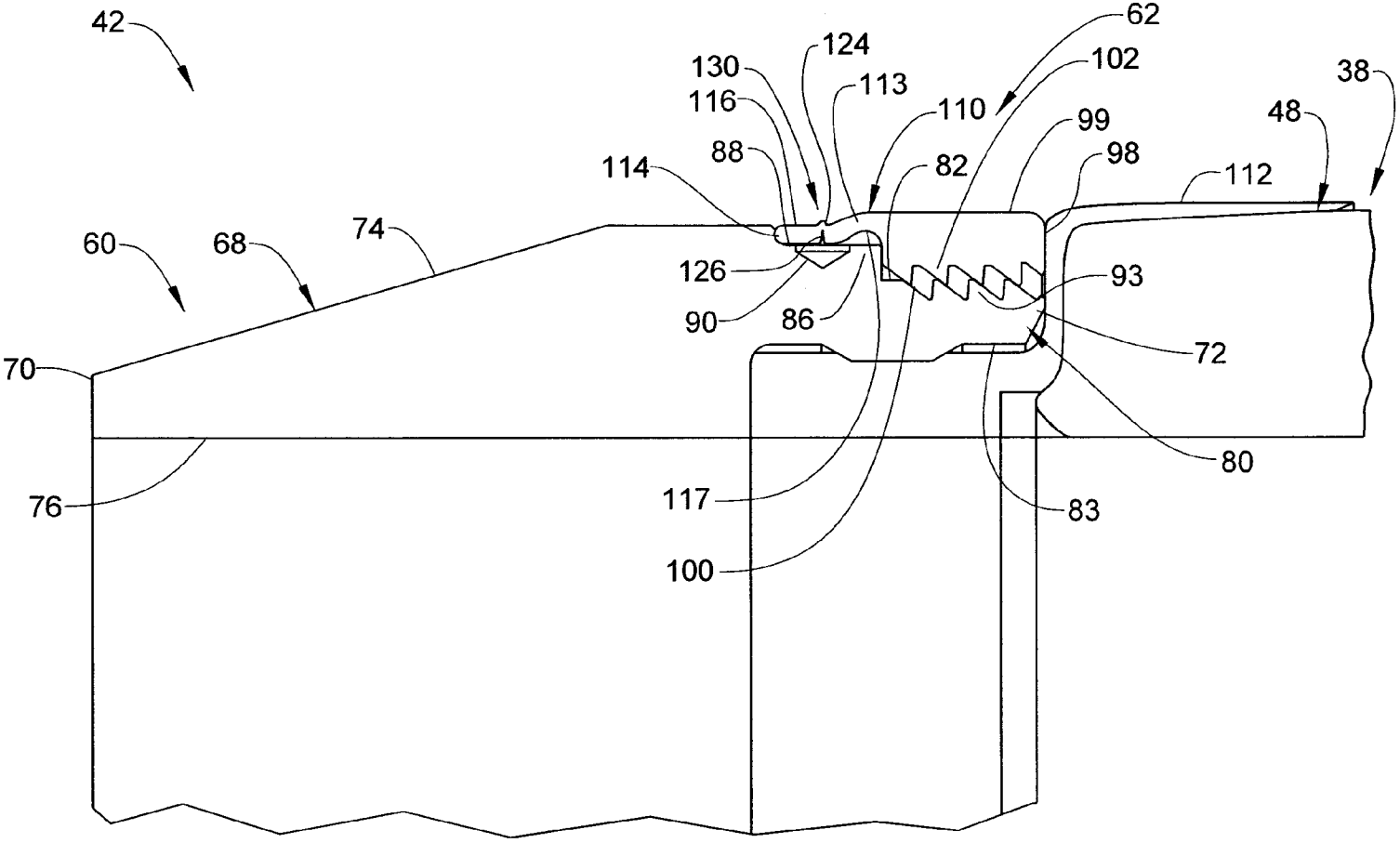
FIG. 4 depicts a partial cross-sectional view of the packing element containment system of FIG. 3 in a set configuration.

As shown in FIGS. 3 and 4, packing element containment system 42 includes a support member 60 and a support ring 62. Support member 60 includes a body 68 extending from a first end 70 to a second end 72. Body 68 includes an outer surface 74 and an inner surface 76. Support member 60 is also shown to include a support ring engagement section 80 provided at second end 72. Support ring engagement section 80 includes an outer surface section 82, an inner surface section 83, and a step section 86 having a step surface 88. A recess 90 may be formed in step surface 88 and a plurality of threads 93 may be formed on outer surface section 82.

Support ring 62 includes a body portion 97 having an axial end 98. Body portion 97 also includes an outer surface portion 99 and an inner surface portion 100 that defines a first radial thickness. Inner surface portion 100 may be provided with a plurality of threads 102 that may engage with threads 93 on outer surface section 82 of support member 60. Support ring 62 also includes a deflection member 110 extending from body portion 97. Interaction between an angled surface 112 of anti-extrusion ring 48 and axial end 98 causes support ring 62 to move over support ring engagement section 80. Plurality of threads 102 move axially over threads 93 converting axial movement of support member 60 relative to support ring 62 into a radial expansion of support ring 62. As support ring 62 moves relative to support member 60, deflection member 110 begins to fold, as will be detailed below.

In accordance with an aspect of an exemplary embodiment, deflection member 110 extends from a first end portion 113, coupled to body portion 97, to a second, cantilevered, end portion 114 and includes a radially outer surface 116 and a radially inner surface 117 that defines a second radial thickness that is less than the first radial thickness. A passage (not separately labeled) extends through deflection member 110 and may be provided with a pin 122 that secures support ring 62 to support member 60. In the exemplary embodiment shown, radially outer surface 116 includes first and second annular grooves 124 and 125. Radially inner surface includes a third annular groove 126 that is arranged between first and second annular groves 124 and 125. Grooves 124-126 form a deformation or folding zone 130.

More specifically, relative axial movement of support member 60 and support ring 62 causes deflection member 110 to contact an abutment surface (not separately labeled) on body 68. Further relative axial movement causes deflection member 110 to bend or fold at annular grooves 124-126. The bending of deflection member 110 allows threads 102 on support ring 62 to shift relative to threads 93 on support member 60. As threads 102 travel axially along threads 93, support ring 62 expands radially outwardly, as shown in FIG. 4, to increase the diameter of the packer 24 relative to surface or pre-set conditions. The phrase "surface or pre-set conditions" should be understood to describe a non-deployed, or non-expanded, configuration of packer 24. In the embodiment illustrated in FIG. 4, the expanded diameter supports anti-extrusion ring 48 in containing packing element 38.

Figure 5:
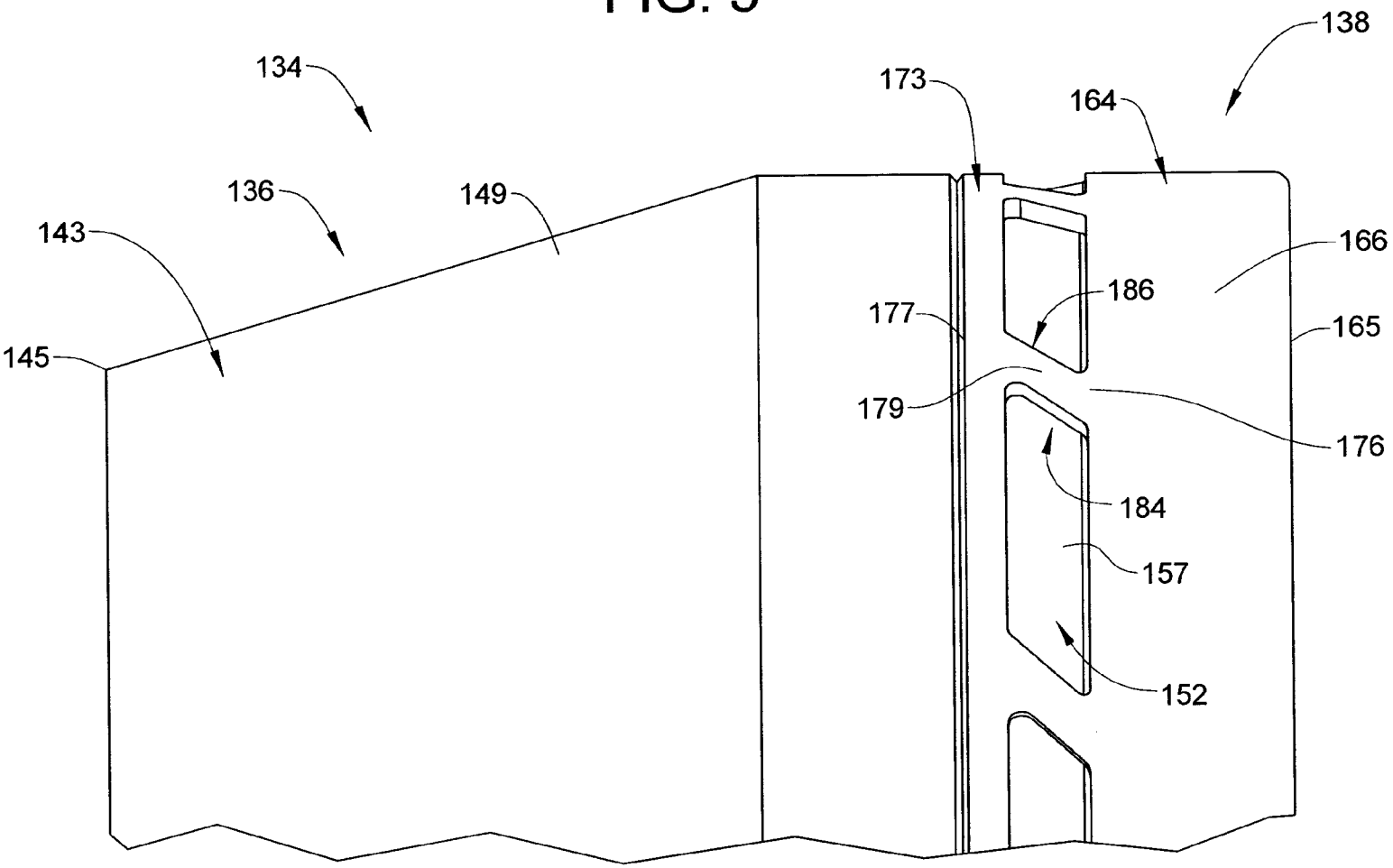
FIG. 5 depicts a packing element containment system, in accordance with another aspect of an exemplary embodiment.
Figure 6:
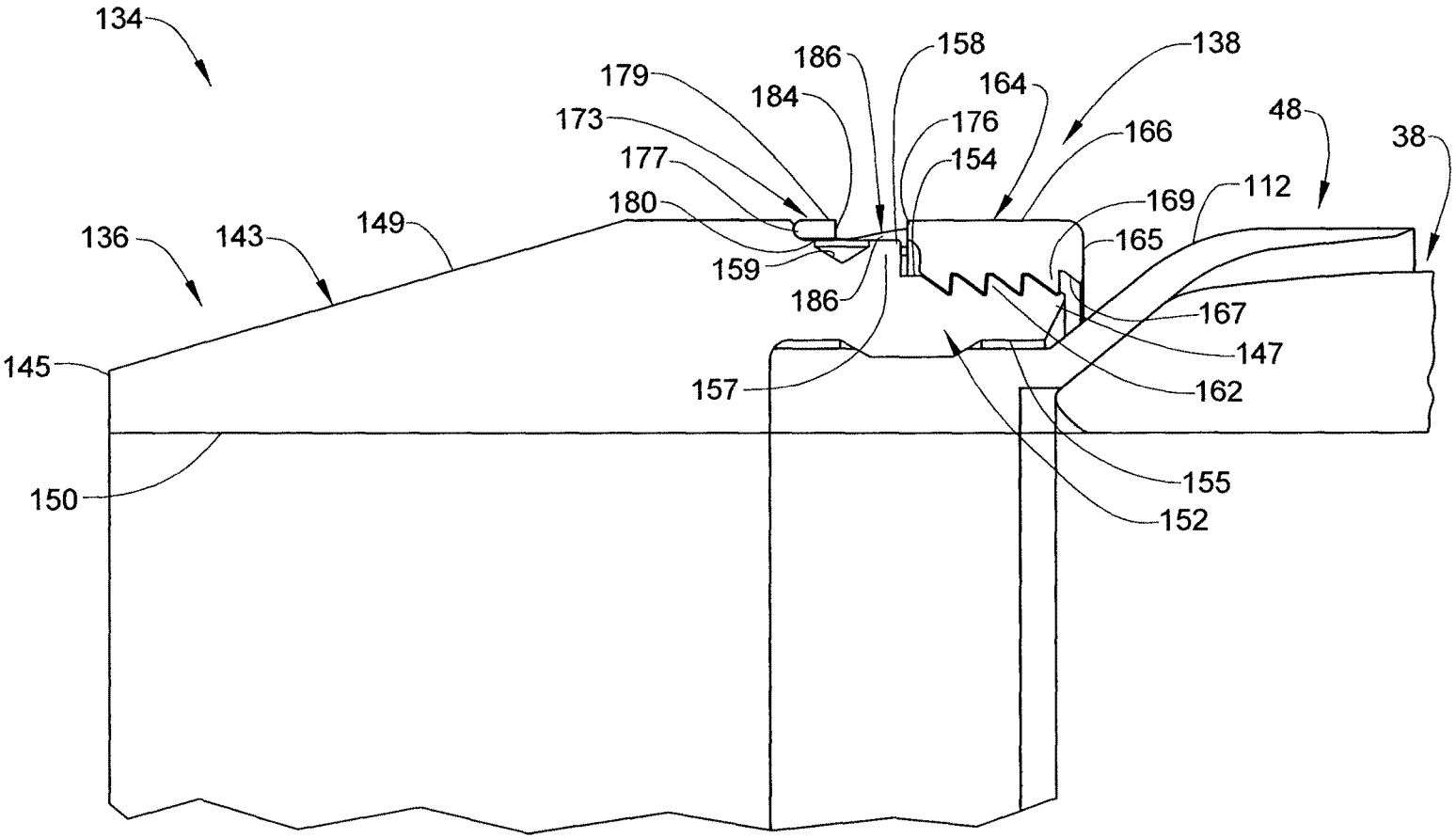
FIG. 6 depicts a partial cross-sectional view of the packing element containment system of FIG. 5 in a run-in configuration.
Figure 7:
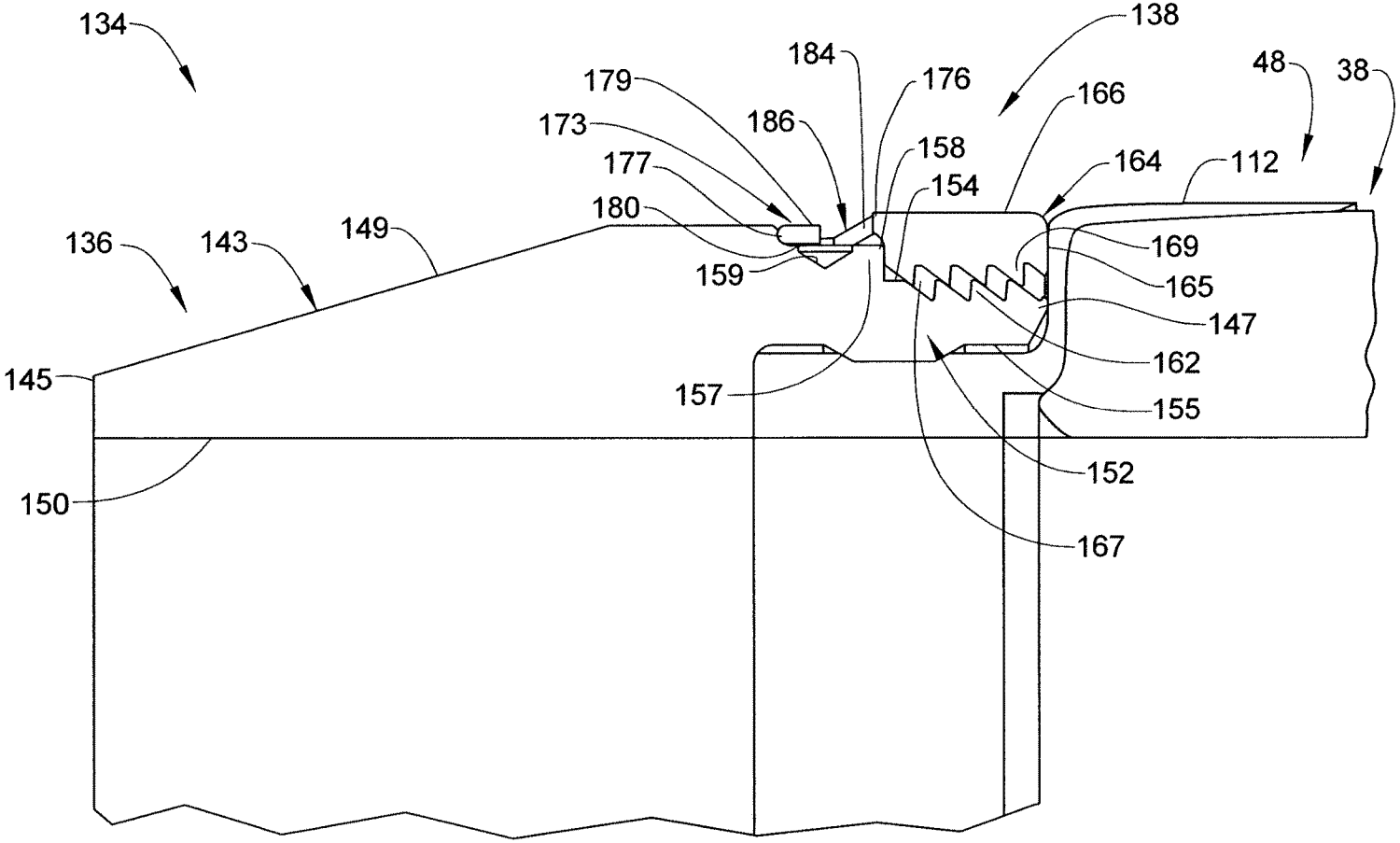
FIG. 7 depicts a partial cross-sectional view of the packing element containment system of FIG. 6 in a set configuration.

Reference will now follow to FIGS. 5-7 in describing a packing element containment system 134 in accordance with another aspect of an exemplary embodiment. Packing element containment system 134 includes a support member 136 and a support ring 138. Support member 136 includes a body 143 extending from a first end 145 to a second end 147. Body 143 includes an outer surface 149 and an inner surface 150. Support member 136 is also shown to include a support ring engagement section 152 provided at second end 147. Support ring engagement section 152 includes an outer surface section 154, an inner surface section 155 and a step section 157 having a step surface 158. A recess 159 may formed in step surface 158 and a plurality of threads 162 may be formed on outer surface section 154.

Support ring 138 includes a body portion 164 having an axial end 165. Body portion 164 further includes an outer surface portion 166 and an inner surface portion 167 that defines a first radial thickness. Inner surface portion 167 may be provided with a plurality of threads 169 that may engage with threads 162 on outer surface section 154 of support member 136. Support ring 138 also includes a deflection member 173 extending from body portion 164. In a manner similar to that described above, deflection member 173 folds or deflects when axial end 165 is forced against angled surface 112 of anti-extrusion ring 48.

In accordance with an aspect of an exemplary embodiment, deflection member 173 extends from a first end portion 176, coupled to body portion 164, to a second, cantilevered, end portion 177 and includes a radially outer surface 179 and a radially inner surface 180 that defines a second radial thickness that is less than the first radial thickness. A plurality of openings, one of which is indicated at 184 extends through deflection member 173. Openings 184 define a plurality of deformation members 186 that extends axially outwardly of body portion 164. In accordance with an aspect of the exemplary embodiment, deformation members 186 extend at an angle relative to an axial axis to allow for axial deformation of deflection member 173.

More specifically, relative axial movement of support member 136 and support ring 138 caused by an axial force applied by anti-extrusion ring 48 causes deflection member 173 to contact an abutment surface (not separately labeled) on body 143. Further relative axial movement causes deformation members 186 to bend. The bending of deformation members 186 allows threads 169 on support ring 138 to shift relative to threads 162 on support member 136. As threads 169 travel axially along threads 162, support ring 138 expands radially outwardly, as shown in FIG. 7, to increase the diameter of the packer 24 relative to surface or pre-set conditions. The expanded diameter supports the anti-extrusion ring 48 in containing the packing element 38. In this manner, packing element containment system 134 converts axial movement of one or more portions of downhole string 20 into radial expansion of support ring 138.

Figure 8:
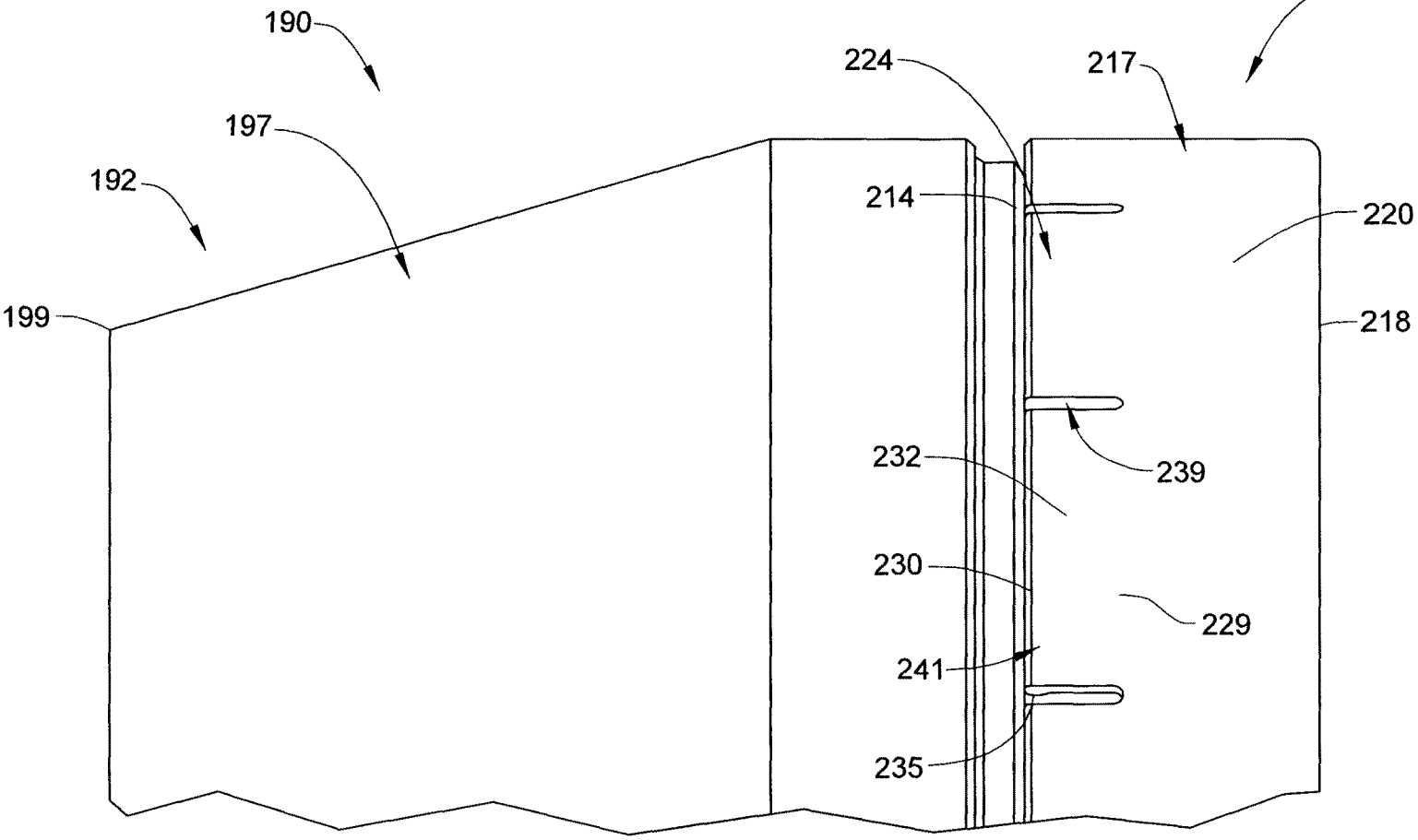
FIG. 8 depicts a packing element containment system, in accordance with yet another aspect of an exemplary embodiment.
Figure 9:
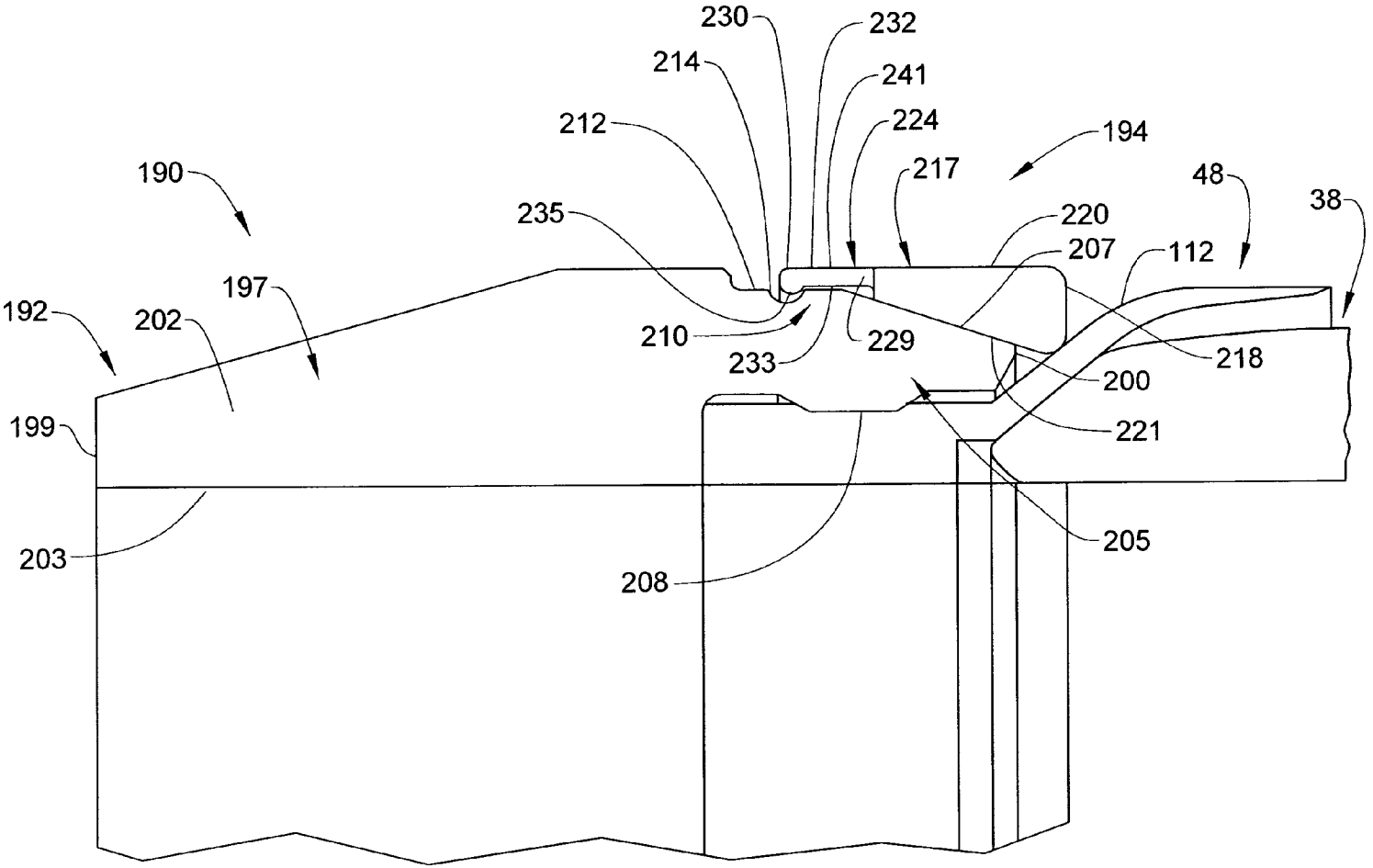
FIG. 9 depicts a partial cross-sectional view of the packing element containment system of FIG. 8 in a run-in configuration.
Figure 10:
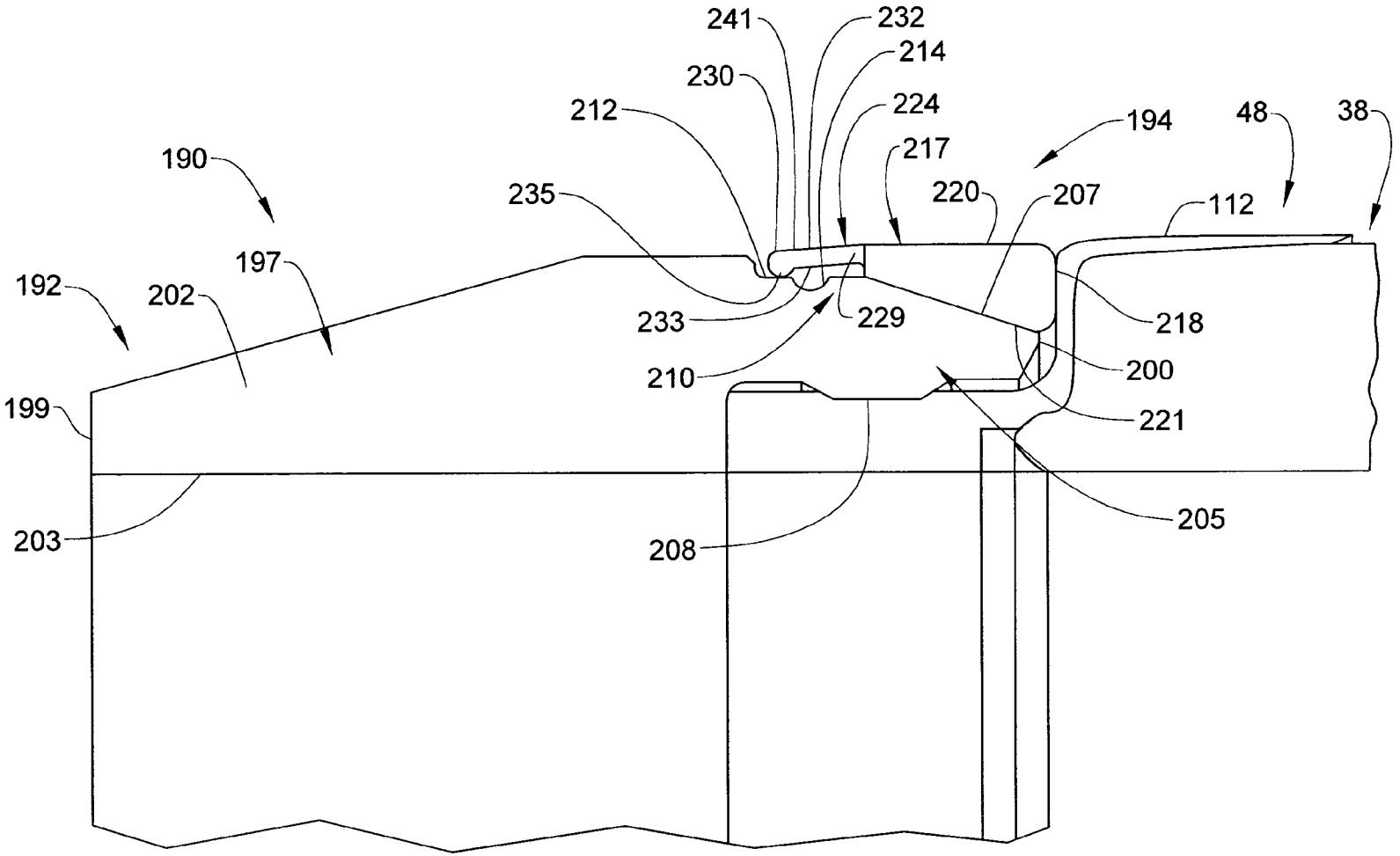
FIG. 10 depicts a partial cross-sectional view of the packing element containment system of FIG. 9 in a set configuration.

Reference will now follow to FIGS. 8-10 in describing a packing element containment system 190 in accordance with another aspect of an exemplary embodiment. Packing element containment system 190 includes a support member 192 and a support ring 194. Support member 192 includes a body 197 extending from a first end 199 to a second end 200. Body 197 includes an outer surface 202 and an inner surface 203. Support member 192 is also shown to include a support ring engagement section 205 provided at second end 200. Support ring engagement section 205 includes an outer, angled surface section 207, an inner surface section 208 and a step section 210 having a step surface 212. An annular groove 214 may be formed in step surface 212.

Support ring 194 includes a body portion 217 having an axial end 218. Body portion 217 further includes outer surface portion 220 and an inner, angled surface portion 221 that defines a first radial thickness. Inner, angled surface portion 221 may compliment outer, angled surface section 207 of support member 192. Support ring 194 also includes a deflection member 224 extending from body portion 217. In a manner similar to that discussed above, deflection member 224 folds or deflects when axial end 218 is forced against angled surface 112 of anti-extrusion ring 48.

In accordance with an aspect of an exemplary embodiment, deflection member 224 extends from a first end portion 229, coupled to body portion 217, to a second, cantilevered, end portion 230 and includes a radially outer surface 232 and a radially inner surface 233 that defines a second radial thickness that is less than the first radial thickness. A snap member 235 is provided at second, cantilevered end portion 230. Snap member 235 snap-fittingly engages with annular groove 214 provided on body 197 to retain support ring 194 relative to support member 192. In accordance with an aspect of the exemplary embodiment, a plurality of slots, one of which is indicated at 239, extends from second, cantilevered end portion 230 toward first end portion 229. Slots 239 form a plurality of deflecting or deformation members 241.

Relative axial movement of support member 192 and support ring 194 resulting from an interaction between axial end 218 and anti-extrusion ring 48 causes snap member 235 to become unseated from annular groove 214, as shown in FIG. 10. Further relative axial movement causes support ring 194 to travel along support ring engagement section 205. As inner angled surface portion 221 travels along outer, angled surface section 207 support ring 194 expands radially outwardly converting axial movement of one or more portions of downhole string 20 into radial expansion of support ring 194.

Figure 11:
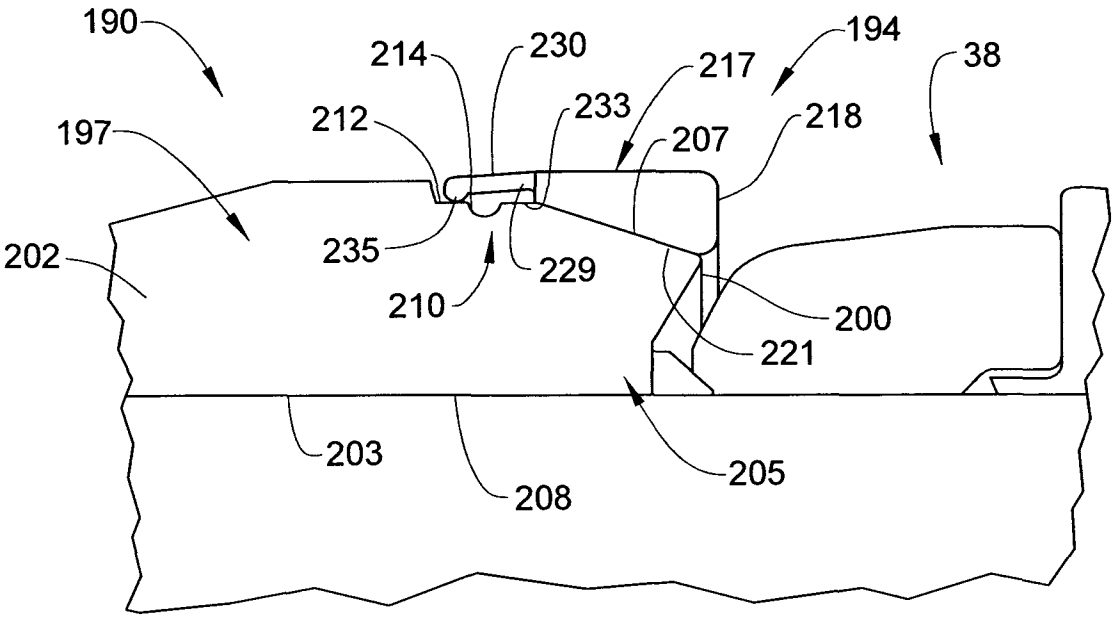
FIG. 11 depicts a partial cross-sectional view of a packing element containment system in a run-in configuration, in accordance with still yet another aspect of an exemplary embodiment.
Figure 12:
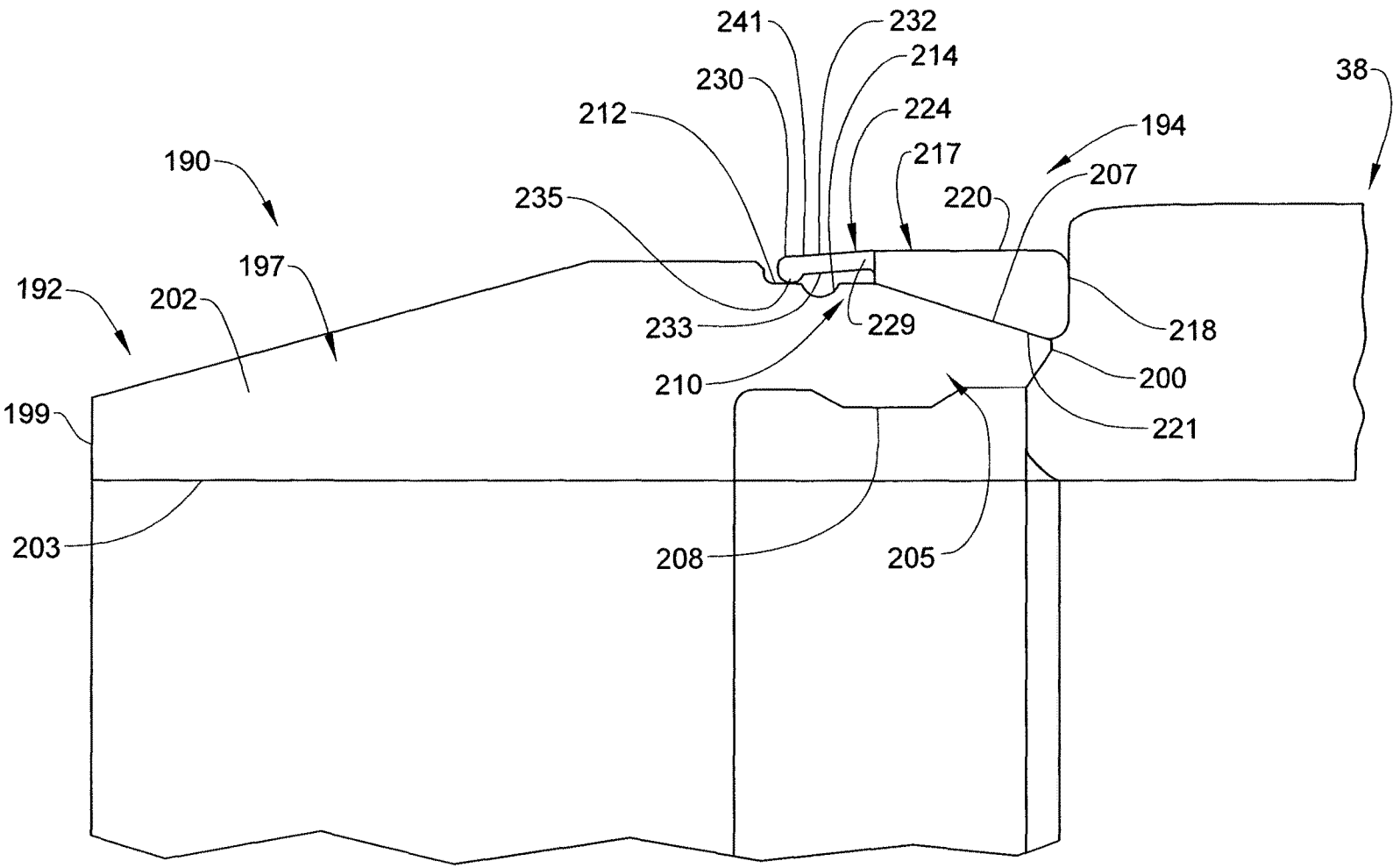
FIG. 12 depicts a partial cross-sectional view of the packing element containment system of FIG. 11 in a set configuration.

At this point, it should be understood that the exemplary embodiments describe a packing element containment system that converts axial movement of a downhole tool to a radial expansion of a support ring to limit extrusion gap of a packing element. While shown on a packer, designed with slip-element-slip packing element employed permanently downhole, the exemplary embodiment may also be employed with retrievable and/or removable packing element systems. It can also be employed in additional packer configurations such as slip-element configuration in which all slips are located above the packing element, sometimes referred to as a "slips above" configuration or an element-slip design in which all slips are located below the packing element, sometimes referred to as the "slips below" configuration. Further, while shown as engaging an anti-extrusion ring, the support ring may also be configured to directly engage a packing element as shown in FIGS. 11 and 12, or alternate embodiments of anti-extrusion rings. In FIG. 12, support ring 194 contains packing element 38. Still further, it should be understood that the particular form of the deflection member may vary. It should be further understood that inter-engaging threads and inter-engaging angled surfaces may be used interchangeably. In addition, while shown in connection with a completion, it should be understood that the packing element containment system may also be employed on any product in a down-hole environment. This includes tools whose functionality can also serve as a "barrier" or "non-barrier" in the down-hole environment.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A packing element containment system comprising:

a support member extending from a first end to a second end, one of the first and second ends including a support ring engagement section integrally formed with the support member and having at least one angled surface section, and a support ring carried by the support ring engagement section of the support member, the support ring having a surface portion including at least one angled surface portion, the support ring being configured and disposed to shift relative to the support member with the at least one angled surface portion moving over the at least one angled surface section converting an axial movement of one of the support ring and the support member to a radial expansion of the support ring to provide one of a support to an anti-extrusion ring and containment for a packing element, wherein the support ring includes a body having a first radial thickness, and a deflection member extending from the body and having a second radial thickness that is less than the first radial thickness, the deflection member connecting the support ring and the support member.

2. The packing element containment system according to claim 1, wherein the support ring is secured to the support member through a pin extending from the deflection member toward the support member.

3. The packing element containment system according to claim 2, wherein the pin is materially and integrally formed with the deflection member.

4. The packing element containment system according to claim 1, wherein the support ring engagement section includes an outer surface section provided with a plurality of threads and the body of the support ring includes an inner surface portion provided with a plurality of threads that engage with the plurality of threads on the outer surface section of the support ring engagement section.

5. The packing element containment system according to claim 1, wherein the deflection member includes a radially outer surface and a radially inner surface, at least one annular groove is formed in the radially outer surface and at least one annular groove is formed in the radially inner surface.

6. The packing element containment system according to claim 5, wherein one of the radially outer and radially inner surfaces includes two annular grooves and the other of the radially outer and radially inner surface includes a single annular groove, the two annular grooves and single annular groove forming a folding zone on the deflection member.

7. The packing element containment system according to claim 1, wherein the deflection member includes a radially outer surface and a radially inner surface, a plurality of openings extend through the radially outer and radially inner surfaces defining a plurality of deformation members.

8. The packing element containment system according to claim 7, wherein each of the plurality of deformation members extend axially outwardly of the body.

9. The packing element containment system according to claim 8, wherein each of the plurality of deformation members extends at an angle relative to an axial axis of the support member.

10. The packing element containment system according to claim 1, wherein the support ring engagement section includes an outer surface section having an annular groove, the deflection member snap-fittingly engaging with the annular groove to secure the support ring to the support member.

11. The packing element containment system according to claim 10, wherein the deflection member includes a cantilevered end portion, a plurality of slots extend axially outwardly of the cantilevered end portion forming a plurality of deflecting members.

12. The packing element containment system according to claim 1, wherein the support ring engagement section includes an angled surface section and the body of the deflection member includes an angled surface portion configured and disposed to axially shift over the angled surface section.

13. The packing element containment system according to claim 1, wherein the support member is mounted to a downhole tool that forms part of a downhole system operatively connected to an uphole system.

14. A method of containing a packing element comprising:

shifting a support ring having at least one angled surface section relative to a support ring engagement section integrally formed with a support member, the support ring engagement section having at least one angled surface portion with an axial force; and deforming a deflection member extending from the support ring, the deflection member connecting the support ring and the support member to transfer the axial force into a radial force through movement of the at least one angled surface section over the at least one angled surface portion causing an outward expansion of the support ring.

15. The method of claim 14, wherein transferring the axial force includes shifting at least one angled surface section on the support ring relative to at least one angled surface portion on the support member.

16. The method of claim 15, wherein shifting the at least one angled surface section on the support ring relative to the at least one angled surface portion on the support member includes axially shifting a first plurality of threads on the support ring relative to a second plurality of threads on the support member.

17. The method of claim 15, wherein shifting the support ring relative to the support member includes unseating a snap member on the support ring from an annular groove formed in the support member.

18. The method of claim 14, wherein shifting the support ring relative to the support member includes engaging a packing element section of a downhole tool to a formation to facilitate extraction of downhole fluids in the formation to an uphole system.

19. The method of claim 14, wherein transferring the axial force into a radial force through an outward expansion of the support ring provides support for an anti-extrusion ring.

20. The method of claim 14, wherein transferring the axial force into a radial force through an outward expansion of the support ring provides containment for a packing element.

* * * * *